US009982919B2

(12) United States Patent
Ali et al.

(10) Patent No.: US 9,982,919 B2
(45) Date of Patent: May 29, 2018

(54) COOLING SYSTEM WITH LOW TEMPERATURE LOAD

(71) Applicant: Heatcraft Refrigeration Products LLC, Stone Mountain, GA (US)

(72) Inventors: Masood Ali, Hatchechubbee, AL (US); Augusto J. Pereira Zimmermann, Lilburn, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 7 days.

(21) Appl. No.: 15/000,350

(22) Filed: Jan. 19, 2016

(65) Prior Publication Data

US 2017/0074550 A1 Mar. 16, 2017

Related U.S. Application Data

(60) Provisional application No. 62/219,261, filed on Sep. 16, 2015.

(51) Int. Cl.

| | |
|---|---|
| ***F25B 1/00*** | (2006.01) |
| ***F25B 1/10*** | (2006.01) |
| ***F25B 9/00*** | (2006.01) |
| ***F25B 31/00*** | (2006.01) |
| *F25B 5/02* | (2006.01) |

(52) U.S. Cl.

CPC ..... *F25B 1/10* (2013.01); *F25B 9/008* (2013.01); *F25B 31/008* (2013.01); *F25B 5/02* (2013.01); *F25B 2309/061* (2013.01); *F25B 2341/0662* (2013.01); *F25B 2400/23* (2013.01); *F25B 2600/2509* (2013.01); *F25B 2600/2515* (2013.01); *F25B 2600/2521* (2013.01)

(58) Field of Classification Search

CPC ..... F25B 1/10; F25B 9/008
USPC ..... 62/115, 498
See application file for complete search history.

(56) References Cited

U.S. PATENT DOCUMENTS

| | | | |
|---|---|---|---|
| 7,143,594 | B2 | 12/2006 | Ludwig et al. |
| 2005/0217292 | A1 | 10/2005 | Onishi et al. |
| 2012/0227427 | A1 | 9/2012 | Liu |
| 2014/0151015 | A1 | 6/2014 | Sun |

FOREIGN PATENT DOCUMENTS

| | | | |
|---|---|---|---|
| JP | 2014/126225 | A | 7/2014 |
| WO | WO 2010/117973 | A2 | 10/2010 |

OTHER PUBLICATIONS

European Patent Office Extended Search Report for Application No./Patent No. 16188784.9-1602, dated Feb. 2, 2017.
European Patent Office Action for Application No./Patent No. 16188784.9-1602, dated Dec. 15, 2017.
European Patent Office Action for Application No./U.S. Pat. No. 16188783.1 - 1008, dated Jan. 19, 2018.

*Primary Examiner* — Melvin Jones
(74) *Attorney, Agent, or Firm* — Baker Botts L.L.P.

(57) ABSTRACT

A system includes a flash tank, a load, a first compressor, a second compressor, and a liquid injection line. The flash tank stores a refrigerant. The load uses the refrigerant from the flash tank to remove heat from a space proximate the load. The first compressor compresses the refrigerant from the load. The second compressor compresses the refrigerant from the first compressor. The liquid injection line is coupled to the flash tank and to the second compressor and sends a liquid refrigerant from the flash tank to mix with the refrigerant from the first compressor before the refrigerant from the first compressor is received by the second compressor.

18 Claims, 4 Drawing Sheets

COOLING SYSTEM WITH LOW TEMPERATURE LOAD

CROSS REFERENCE TO RELATED APPLICATIONS

This application claims the benefit of U.S. Provisional Application Ser. No. 62/219,261, entitled "Compressor Suction Superheat Control Methods for $CO_2$ Transcritical Booster Cycle with Low Temperature Load," which was filed Sep. 16, 2015, having common inventorship, the entire contents of which are incorporated herein by reference.

TECHNICAL FIELD

This disclosure relates generally to a cooling system, specifically a cooling system with a low temperature load.

BACKGROUND

Refrigeration systems may be configured in a carbon dioxide booster system. This system may cycle $CO_2$ refrigerant to cool a space using refrigeration. The refrigerant may be cycled through a low temperature load, low temperature compressor(s), a medium temperature load, and medium temperature compressor(s). However, when the medium temperature load is not present, the temperature of the refrigerant cycled through the medium temperature compressor(s) may be too high for the medium temperature compressor(s) to handle, which may lead to unsafe operating conditions.

SUMMARY OF THE DISCLOSURE

According to one embodiment, a system includes a high side heat exchanger, a flash tank, a load, a first compressor, a second compressor, a flash gash bypass line, and a liquid injection line. The high side heat exchanger removes heat from a refrigerant. The flash tank stores the refrigerant from the high side heat exchanger. The load uses the refrigerant from the flash tank to remove heat from a space proximate the load. The first compressor compresses the refrigerant from the load. The second compressor compresses the refrigerant from the first compressor and sends the refrigerant to the high side heat exchanger. The flash gas bypass line is coupled to the flash tank and to the second compressor. The flash gas bypass line sends a flash gas from the flash tank to mix with the refrigerant from the first compressor before the refrigerant from the first compressor is received by the second compressor. The liquid injection line is coupled to the flash tank and to the second compressor. The liquid injection line sends a liquid refrigerant from the flash tank to mix with the refrigerant from the first compressor before the refrigerant from the first compressor is received by the second compressor.

According to another embodiment, a method includes removing heat from a refrigerant by a high side heat exchanger and storing, by a flash tank, the refrigerant from the high side heat exchanger. The method also includes using, by a load, the refrigerant from the flash tank to remove heat from a space proximate the load and compressing, by a first compressor, the refrigerant from the load. The method further includes compressing, by a second compressor, the refrigerant from the first compressor and sending, by the second compressor, the refrigerant to the high side heat exchanger. The method also includes sending, by a flash gas bypass line coupled to the flash tank and to the second compressor, a flash gas from the flash tank to mix with the refrigerant from the first compressor before the refrigerant from the first compressor is received by the second compressor. The method further includes sending, by a liquid injection line coupled to the flash tank and to the second compressor, a liquid refrigerant from the flash tank to mix with the refrigerant from the first compressor before the refrigerant from the first compressor is received by the second compressor.

According to yet another embodiment, a system includes a flash tank, a load, a first compressor, a second compressor, and a liquid injection line. The flash tank stores a refrigerant. The load uses the refrigerant from the flash tank to remove heat from a space proximate the load. The first compressor compresses the refrigerant from the load. The second compressor compresses the refrigerant from the first compressor. The liquid injection line is coupled to the flash tank and to the second compressor and sends a liquid refrigerant from the flash tank to mix with the refrigerant from the first compressor before the refrigerant from the first compressor is received by the second compressor.

Certain embodiments may provide one or more technical advantages. For example, an embodiment allows for the safe operation of a medium temperature compressor when a medium temperature load is not present in a $CO_2$ booster system by mixing liquid refrigerant from a flash tank with a refrigerant going into a medium temperature compressor. As another example, an embodiment reduces the temperature and/or pressure of a superheated refrigerant by mixing the refrigerant with liquid refrigerant from a flash tank. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 4 of the drawings, like numerals being used for like and corresponding parts of the various drawings.

Cooling systems, such as for example refrigeration systems, may be configured in a $CO_2$ booster configuration. These systems may cycle refrigerant from a flash tank through low temperature loads and medium temperature loads to cool spaces corresponding to those loads. For example, in a grocery store, the low temperature loads may be freezers used to store frozen foods and the medium temperature loads may be refrigerated shelves used to store fresh produce. The refrigerant from the low temperature load is sent through low temperature compressors, and then that compressed refrigerant is mixed with refrigerant from the medium temperature load and refrigerant from the flash tank. That mixture is then sent through medium temperature compressors and then cycled back to the condenser.

By mixing the refrigerant from the low temperature compressor with refrigerant from the medium temperature load and from the flash tank, the temperature of the refrigerant from the low temperature compressor may be reduced before being sent to the medium temperature compressor. However, when the medium temperature load is not present and/or removed from the refrigeration system, the refrigerant from the medium temperature load is not included in the mixture. As a result, the temperature of the mixture may be too high for the medium temperature compressors to handle safely. Unsafe operating conditions may result if that mixture is sent to the medium temperature compressors (e.g., cracking the medium temperature compressors and/or causing the medium temperature compressors to fail).

This disclosure contemplates a configuration of the refrigeration system that lowers the temperature of the unsafe mixture and avoids such unsafe operating conditions. In the configuration, the refrigerant from the low temperature compressor is mixed with liquid refrigerant and flash gas from a flash tank before being received by the medium temperature compressor. The liquid refrigerant is provided through a liquid injection line controlled by a pulse valve. A controller controls the operation of the pulse valve based on measurements from a temperature sensor and a pressure sensor at the medium temperature compressor. The flash gas is provided through a flash gas bypass line. In this manner, the refrigerant may be cooled by the liquid refrigerant and the flash gas in the flash tank before being sent to the medium temperature compressor.

Figure 1:
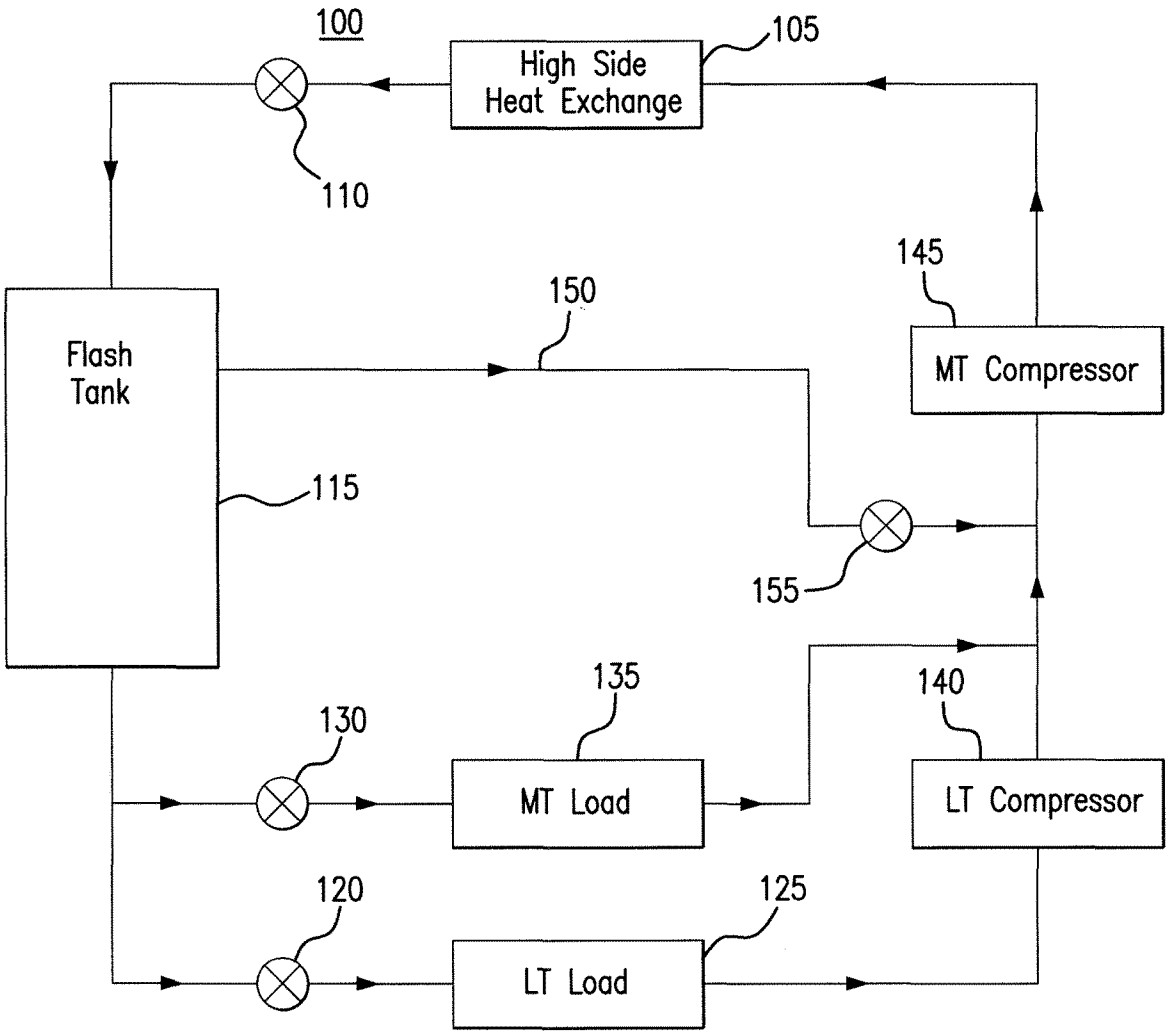
FIG. 1 illustrates an example cooling system in a booster configuration.
Figure 2:
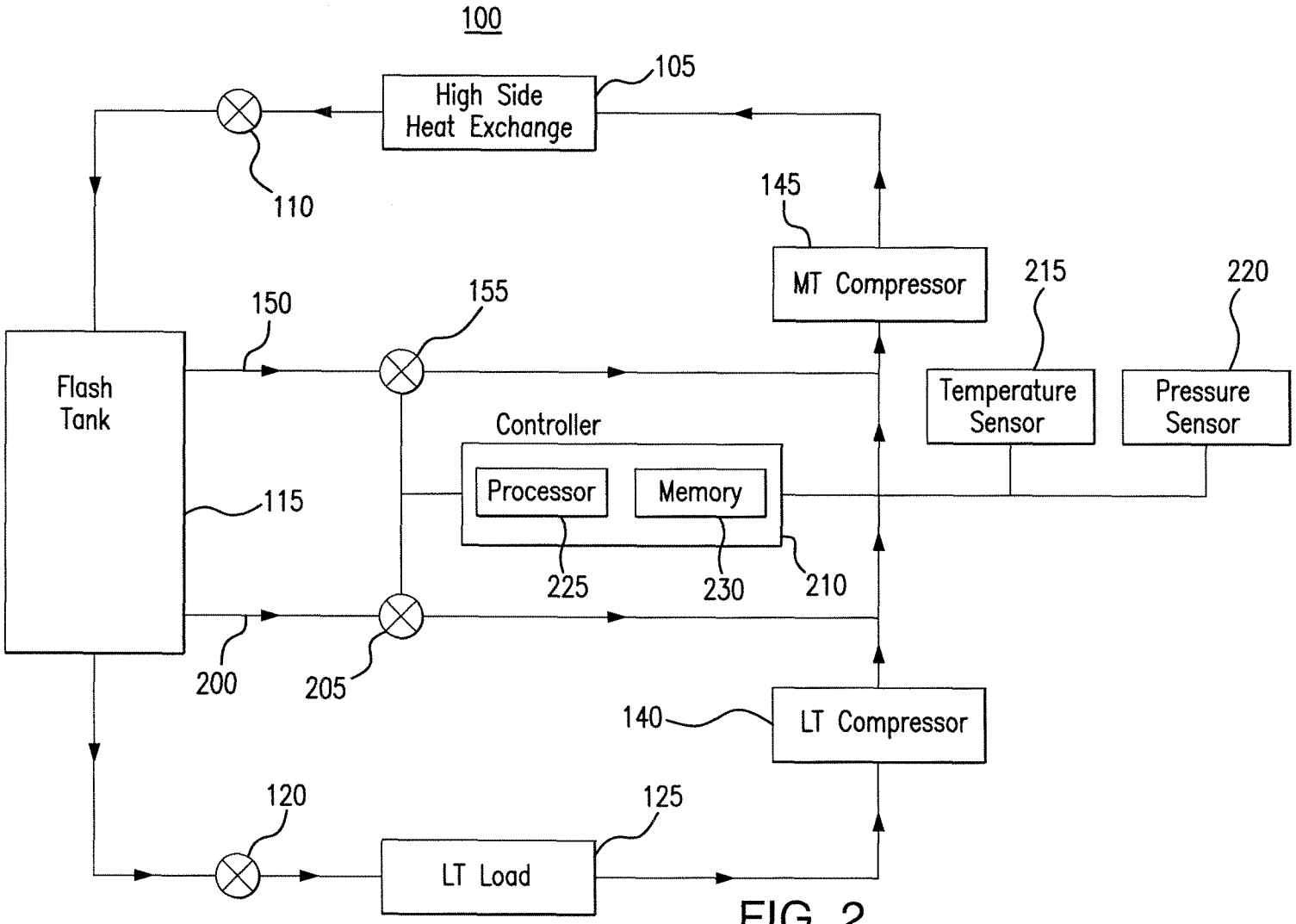
FIG. 2 illustrates an example cooling system in a booster configuration without a medium temperature load.
Figure 3:
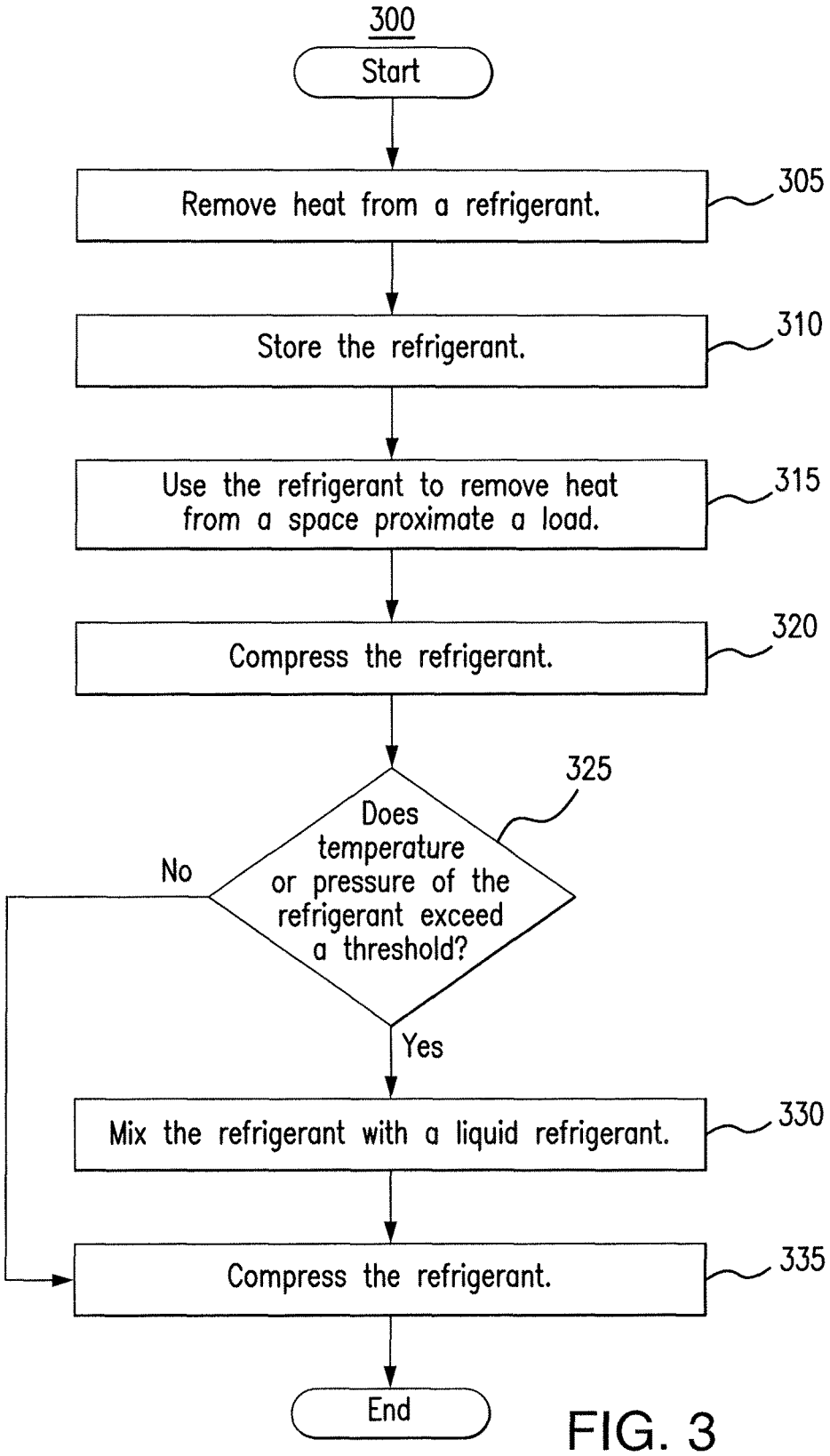
FIG. 3 is a flowchart illustrating a method of operating the example cooling system of FIG. 2.
Figure 4:
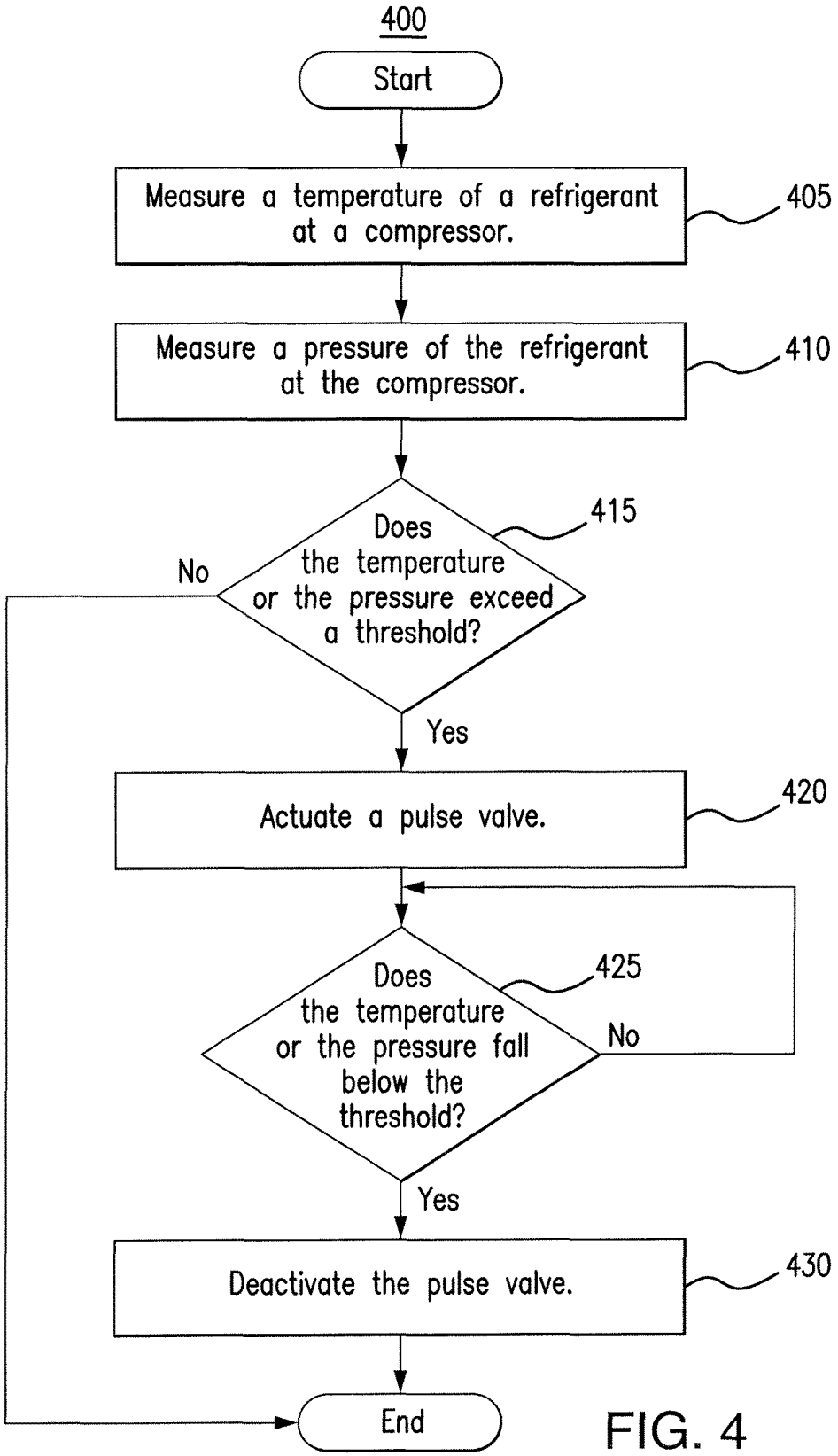
FIG. 4 is a flowchart illustrating a method of operating the example cooling system of FIG. 2.

Cooling systems and the contemplated configuration will be discussed in more detail using FIGS. 1 through 4. FIG. 1 shows a cooling system with a medium temperature load. FIG. 2 shows the cooling system of FIG. 1 configured without a medium temperature load. FIGS. 3 and 4 describe the operation of the system of FIG. 2.

As provided in FIG. 1, system 100 includes a high side heat exchanger 105, an expansion valve 110, a flash tank 115, an expansion valve 120, a low temperature load 125, expansion valve 130, a medium temperature load 135, a low temperature compressor 140, a medium temperature compressor 145, and a flash gas bypass line 150. System 100 may circulate a refrigerant to remove heat from spaces proximate low temperature load 125 and medium temperature load 135.

High side heat exchanger 105 may remove heat from the refrigerant. When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools the refrigerant but the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Expansion valves 110, 120, and 130 reduce the pressure and therefore the temperature of the refrigerant. Expansion valves 110, 120, and 130 reduce pressure from the refrigerant flowing into the expansion valves 110, 120, and 130. The temperature of the refrigerant may then drop as pressure is reduced. As a result, warm or hot refrigerant entering expansion valves 110, 120, and 130 may be cooler when leaving expansion valves 110, 120, and 130. The refrigerant leaving expansion valve 110 is fed into flash tank 115. Expansion valves 120 and 130 feed low temperature load 125 and medium temperature load 135 respectively.

Flash tank 115 may store refrigerant received from high side heat exchanger 105 through expansion valve 110. This disclosure contemplates flash tank 115 storing refrigerant in any state such as, for example, a liquid state and/or a gaseous state. Refrigerant leaving flash tank 115 is fed to low temperature load 125 and medium temperature load 135 through expansion valves 120 and 130. Flash tank 115 is referred to as a receiving vessel in certain embodiments.

System 100 may include a low temperature portion and a medium temperature portion. The low temperature portion may operate at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods and the medium temperature portion may include refrigerated shelves used to hold produce. Refrigerant may flow from flash tank 115 to both the low temperature and medium temperature portions of the refrigeration system. For example, the refrigerant may flow to low temperature load 125 and medium temperature load 135. When the refrigerant reaches low temperature load 125 or medium temperature load 135, the refrigerant removes heat from the air around low temperature load 125 or medium temperature load 135. As a result, the air is cooled. The cooled air may then be circulated such as, for example, by a fan to cool a space such as, for example, a freezer and/or a refrigerated shelf. As refrigerant passes through low temperature load 125 and medium temperature load 135 the refrigerant may change from a liquid state to a gaseous state.

Refrigerant may flow from low temperature load 125 and medium temperature load 135 to compressors 140 and 145. This disclosure contemplates system 100 including any number of low temperature compressors 140 and medium temperature compressors 145. Both the low temperature compressor 140 and medium temperature compressor 145 may be configured to increase the pressure of the refrigerant. As a result, the heat in the refrigerant may become concentrated and the refrigerant may become a high pressure gas. Low temperature compressor 140 may compress refrigerant from low temperature load 125 and send the compressed refrigerant to medium temperature compressor 145. Medium temperature compressor 145 may compress refrigerant from low temperature compressor 140 and medium temperature load 135. Medium temperature compressor 145 may then send the compressed refrigerant to high side heat exchanger 105.

Medium temperature compressor 145 may not be able to safely compress the refrigerant if the temperature of that refrigerant is too high. To regulate the temperature of the refrigerant received by medium temperature compressor 145, the refrigerant from low temperature compressor 140 may be mixed with a cooler refrigerant coming from medium temperature load 135 before being received by medium temperature compressor 145. The refrigerant from low temperature compressor 140 may further be mixed with a cooler flash gas from flash tank 115 via flash gas bypass line 150. By cooling the refrigerant from low temperature compressor 140 before it is received by medium temperature compressor 145 may allow medium temperature compressor 145 to safely compress the received refrigerant.

To better regulate the temperature and/or pressure of the refrigerant received by medium temperature compressor 145, flash gas bypass line 150 may be used to mix flash gas from flash tank 115 with the refrigerant from low temperature compressor 140 and medium temperature load 135 before that refrigerant is received by medium temperature compressor 145. The flash gas supplied by flash gas bypass line 150 cools the refrigerant before the refrigerant is received by medium temperature compressor 145. Flash gas bypass line 150 includes flash gas bypass valve 155. In certain embodiments, flash gas bypass valve 155 further cools the flash gas coming from flash tank 115. In some embodiments, flash gas bypass valve 155 is piloted based on an interior pressure of flash tank 115. For example, flash gas bypass valve 155 may open when the interior pressure of flash tank 115 exceeds a configured threshold for flash gas bypass valve 155. Flash gas bypass valve 155 controls the flow of flash gas through flash gas bypass line 150. When flash gas bypass valve 155 is open, flash gas can flow from flash tank 115 through flash gas bypass line 150. When flash gas bypass valve 155 is closed, flash gas cannot flow from flash tank 115 through flash gas bypass line 150. During operation of system 100, flash gas bypass valve 155 may be in a position such that an internal pressure of flash tank 115 is maintained at an optimum set point for energy efficiency.

In particular embodiments, the refrigerant from low temperature compressor 140 (125° F.-140° F.) is cooled by both the refrigerant from medium temperature load 135 (25° F.-35° F.) and the refrigerant from flash gas bypass line 150 (21° F.) at a ratio of about 10%-15% from low temperature load 140, 45%-50% from medium temperature load 135, and 30%-40% from flash gas bypass line 150. This allows medium temperature compressor 145 to operate safely.

The operation of system 100 as illustrated in FIG. 1 may depend on the presence of medium temperature load 135. If medium temperature load 135 is not present, then the refrigerant received by medium temperature compressor 145 may be too high a temperature for medium temperature compressor 145 to safely compress. This disclosure contemplates a configuration of system 100 that may allow medium temperature compressor 145 to safely compress a received refrigerant when medium temperature load 135 is not present. FIG. 2 illustrates the alternative configuration. FIGS. 3 and 4 describe the operation of the alternative configuration.

FIG. 2 illustrates the example cooling system 100 of FIG. 1 configured without a medium temperature load. As shown in FIG. 2, system 100 includes a low temperature load 125 but no medium temperature load. Furthermore, system 100 includes a liquid injection line 200, a pulse or stepper valve 205, a controller 210, a temperature sensor 215, and a pressure sensor 220. Each of these components may operate to regulate the temperature and/or pressure of the refrigerant received by medium temperature compressor 145.

When the medium temperature load is removed from system 100 it may no longer be possible to mix the refrigerant from low temperature compressor 140 with the refrigerant from the medium temperature load. As a result, the refrigerant received by medium temperature compressor 145 may be too hot for medium temperature compressor 145 to safely compress. When medium temperature compressor 145 cannot safely compress the refrigerant, system 100 may malfunction or refrigerant may be discharged from system 100.

To regulate the temperature and/or pressure of the refrigerant received by medium temperature compressor 145 in the absence of the medium temperature load, system 100 may mix the refrigerant from low temperature compressor 140 with liquid refrigerant from flash tank 115. Mixing in the liquid refrigerant from flash tank 115 lowers the temperature of the refrigerant from low temperature compressor 140 such that medium temperature compressor 145 may safely compress the refrigerant. As a result, system 100 may operate safely even when the medium temperature load is removed.

Liquid injection line 200 allows for the flow of liquid refrigerant from flash tank 115. The liquid refrigerant may flow through liquid injection line 200 to mix with refrigerant from low temperature compressor 140. As a result, the refrigerant from low temperature compressor 140 may be cooled before the refrigerant is received by medium temperature compressor 145.

Valve 205 may be a pulse valve, a stepper valve, or any other appropriate valve. Valve 205 may control the flow of liquid refrigerant through liquid injection line 200. For example, when valve 205 is opened, liquid refrigerant may flow through liquid injection line 200 to mix with the refrigerant from low temperature compressor 140. When valve 205 is closed, liquid refrigerant may not flow through liquid injection line 200. In particular embodiments, valve 205 may be operated in conjunction with flash gas bypass valve 155 to improve the control of the flow of liquid refrigerant through liquid injection line 200. For example, opening and/or closing flash gas bypass valve 155 may cause a pressure differential in the refrigerant line that helps the liquid refrigerant from flash tank 115 to be injected into the refrigerant line. As a result, the liquid refrigerant is mixed with the refrigerant from low temperature compressor 140 before the refrigerant is received by medium temperature compressor 145. In certain embodiments, by mixing the liquid refrigerant from flash tank 115 with the refrigerant from low temperature compressor 140, the temperature of the refrigerant from low temperature compressor 140 may be lowered such that medium temperature compressor 145 may safely compress the refrigerant.

Controller 210 may operate valve 205 and flash gas bypass valve 155 based on measurements taken by temperature sensor 215 and/or pressure sensor 220. As illustrated in FIG. 2, controller 210 includes a processor 225 and a memory 230. This disclosure contemplates processor 225 and memory 230 being configured to perform any of the functions of controller 210 described herein.

Processor 225 is any electronic circuitry, including, but not limited to microprocessors, application specific integrated circuits (ASIC), application specific instruction set processor (ASIP), and/or state machines, that communicatively couples to memory 230 and controls the operation of controller 210. Processor 225 may be 8-bit, 16-bit, 32-bit, 64-bit or of any other suitable architecture. Processor 225 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. Processor 225 may include other hardware and software that operates to control and process information. Processor 225 executes software stored on memory 230 to perform any of the functions described herein. Processor 225 controls the operation and administration of controller 210 by processing information received from components of system 100, such as for example, temperature sensor 215 and pressure sensor 220. Processor 225 may be a programmable logic device, a microcontroller, a microprocessor, any suitable processing device, or any suitable combination of the preceding. Processor 225 is not limited to a single processing device and may encompass multiple processing devices.

Memory 230 stores, either permanently or temporarily, data, operational software, or other information for processor 225. Memory 230 includes any one or a combination of volatile or non-volatile local or remote devices suitable for storing information. For example, memory 230 may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in memory 230, a disk, a CD, or a flash drive. In particular embodiments, the software may include an application executable by processor 225 to perform one or more of the functions described herein.

Controller 210 may receive a temperature measurement from temperature sensor 215. Temperature sensor 215 may be positioned in the refrigerant line to measure the temperature of the refrigerant before it is received by medium temperature compressor 145. Controller 210 may also receive a pressure measurement from pressure sensor 220. Pressure sensor 220 may be positioned in the refrigerant line to measure the pressure of the refrigerant before it is received by medium temperature compressor 145.

Controller 210 may compare the measured temperature and/or pressure of the refrigerant against a threshold. If one or more of the measured temperature and/or pressure exceeds the threshold, controller 210 may operate valve 205 and flash gas bypass valve 155 to inject liquid refrigerant from flash tank 115 into the refrigerant line. As a result, the liquid refrigerant mixes with the refrigerant from low temperature compressor 140 and lowers the temperature of the refrigerant before it is received by medium temperature compressor 145. For example, controller 210 may actuate valve 205 if one or more of the measured temperature and/or the measured pressure exceed the threshold. In particular embodiments, when valve 205 is not actuated, controller 210 may keep flash gas bypass valve 155 in a position such that an internal pressure of flash tank 115 is maintained at an optimum set point for energy efficiency. The internal pressure of flash tank 115 may differ from the optimum set point when valve 205 is actuated.

Temperature sensor 215 and pressure sensor 220 may continue to measure the temperature and the pressure of the refrigerant in the refrigerant line. Controller 210 may continue to monitor these measurements. When one or more of the temperature and/or pressure of the refrigerant falls below the threshold, controller 210 may deactivate and/or close valve 205 so as to stop the injection of liquid refrigerant into the refrigerant line.

In certain embodiments, controller 210 may open and/or actuate valve 205 when a pressure differential between medium temperature compressor 145 and liquid injection line 200 is at least 45 pounds per square inch. Controller 210 may determine this pressure differential based on measurements from pressure sensor 220. In some embodiments, controller 210 may operate flash gas bypass valve 155 to create a pressure differential of at least 45 pounds per square inch between medium temperature compressor 145 and liquid injection line 200.

In particular embodiments, controller 210 may operate valve 205 and/or flash gas bypass valve 155 based on a rate of change of one or more of the measured temperature and/or the measured pressure of the refrigerant in the refrigerant line. For example, controller 210 may monitor a rate of change of one or more of the measured temperature and the measured temperature. Controller 210 may compare the rate of change against a threshold for the rate of change. Controller 210 may also compare the measured temperature and the measured pressure against a threshold. If the rate of change exceeds the threshold for the rate of change and one or more of the measured temperature or measured pressure exceed the threshold, then controller 210 may begin closing flash gas bypass valve 155. As a result, pressure in flash tank 115 may increase which allows for the liquid refrigerant from flash tank 115 to be injected through liquid injection line 200. By operating valve 205 and flash gas bypass valve 155 based on the rate of change of the measured temperature and the measured pressure, the temperature and/or pressure of the refrigerant in the refrigerant line may be better regulated.

By controlling the operation of valve 205, the temperature and/or pressure of the refrigerant from low temperature compressor 140 may be regulated such that medium temperature compressor 145 may safely compress the refrigerant in certain embodiments. As a result, system 100 may operate safely.

In particular embodiments, system 100 may include a second high side heat exchanger that removes heat from the refrigerant. The second high side heat exchanger is positioned between low temperature compressor 140 and medium temperature compressor 145. The second high side heat exchanger may operate as a gas cooler or as a condenser. The second high side heat exchanger may receive refrigerant from low temperature compressor 140, remove heat from that refrigerant, and then send the refrigerant to medium temperature compressor 145. In this manner, additional heat may be removed from the refrigerant before it is received by medium temperature compressor 145.

In certain embodiments, controller 210 may fully open flash gas bypass valve 155 when one or more of the measured temperature and the measured pressure does not exceed a threshold. In this manner, flash gas from flash tank 115 may mix with refrigerant from low temperature compressor 140 before it is received by medium temperature compressor 145. As a result, the temperature and/or pressure of the refrigerant in the refrigerant line may be better maintained.

FIG. 3 is a flowchart illustrating a method 300 of operating the example cooling system 100 of FIG. 2. In particular embodiments, various components of system 100 perform method 300. By performing method 300, the temperature and/or pressure of a refrigerant received by a medium temperature compressor can be regulated in the absence of a medium temperature load in system 100.

A high side heat exchanger may begin method 300 by removing heat from a refrigerant in step 305. In step 310, a flash tank stores the refrigerant. Then a low temperature load uses the refrigerant to remove heat from a space proximate the load in step 315. In step 320, a low temperature compressor compresses the refrigerant.

In step 325, a controller determines whether a temperature or a pressure of the refrigerant exceeds a threshold. If the pressure and the temperature do not exceed the threshold, then a medium temperature compressor compresses the refrigerant in step 335. If one or more of the temperature or the pressure exceeds the threshold, then a liquid refrigerant is mixed with the refrigerant. In step 330, the liquid refrigerant stored in the flash tank is sent to the refrigerant line through a liquid injection line. As a result, the refrigerant from a low temperature compressor is cooled before the refrigerant is received by the medium temperature compressor. Then in step 335, the medium temperature compressor compresses the refrigerant.

FIG. 4 is a flowchart illustrating a method 400 of operating the example cooling system 100 of FIG. 2. In particular embodiments, controller 210 performs method 400. By performing method 400, the temperature and/or pressure of a refrigerant received by a medium temperature compressor may be regulated.

Controller 210 begins by measuring a temperature of a refrigerant at a compressor in step 405. Controller 210 receives this measurement from a temperature sensor. In step 410, controller 210 measures a pressure of the refrigerant at the compressor. Controller 210 may receive this measurement from a pressure sensor.

In step 415, controller 210 determines whether the temperature or the pressure exceeds the threshold. If the temperature and the pressure do not exceed the threshold, controller 210 concludes method 400. If the temperature or the pressure exceed the threshold, the controller 210 continues to step 420 to actuate a pulse valve.

In step 425, controller 210 determines whether the temperature or the pressure fall below the threshold. If the temperature and the pressure do not fall below the threshold, controller 210 waits until the temperature or the pressure fall below the threshold to continue. If the temperature or the pressure fall below the threshold, then controller 210 continues to step 430 to deactivate the pulse valve.

Modifications, additions, or omissions may be made to methods 300 and 400 depicted in FIGS. 3 and 4. Methods 300 and 400 may include more, fewer, or other steps. For example, steps may be performed in parallel or in any suitable order. While discussed as various components of cooling system 100 performing the steps, any suitable component or combination of components of system 100 may perform one or more steps of methods 300 and 400.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a high side heat exchanger configured to remove heat from a refrigerant;

a flash tank configured to store the refrigerant from the high side heat exchanger;

a load configured to use the refrigerant from the flash tank to remove heat from a space proximate the load;

a first compressor configured to compress the refrigerant from the load;

a second compressor configured to compress the refrigerant from the first compressor, the second compressor configured to send the refrigerant to the high side heat exchanger;

a flash gas bypass line coupled to the flash tank and to the second compressor, the flash gas bypass line configured to send a flash gas from the flash tank to mix with the refrigerant from the first compressor before the refrigerant from the first compressor is received by the second compressor;

a flash gas bypass valve coupled to the flash gas bypass line, the flash gas bypass valve configured to control the flow of flash gas through the flash gas bypass line; and a liquid injection line coupled to the flash tank and to the second compressor, the liquid injection line configured to send a liquid refrigerant from the flash tank to mix with the refrigerant from the first compressor before the refrigerant from the first compressor is received by the second compressor.

2. The system of claim 1, further comprising a second high side heat exchanger configured to remove heat from the refrigerant from the first compressor, the second high side heat exchanger configured to send the refrigerant to the second compressor.

3. The system of claim 1, further comprising a pulse valve coupled to the liquid injection line, the pulse valve configured to control the flow of the liquid refrigerant through the liquid injection line.

4. The system of claim 3, wherein the pulse valve is configured to open when a pressure differential between the second compressor and the liquid injection line is at least 45 pounds per square inch.

5. The system of claim 1, wherein the flash gas bypass valve is configured to create a pressure differential of at least 45 pounds per square inch between the second compressor and the liquid injection line.

6. The system of claim 1, wherein the high side heat exchanger is operated as a gas cooler.

7. A method comprising:

removing heat from a refrigerant by a high side heat exchanger;

storing, by a flash tank, the refrigerant from the high side heat exchanger;

using, by a load, the refrigerant from the flash tank to remove heat from a space proximate the load;

compressing, by a first compressor, the refrigerant from the load;

compressing, by a second compressor, the refrigerant from the first compressor;

sending, by the second compressor, the refrigerant to the high side heat exchanger;

sending, by a flash gas bypass line coupled to the flash tank and to the second compressor, a flash gas from the flash tank to mix with the refrigerant from the first compressor before the refrigerant from the first compressor is received by the second compressor; and sending, by a liquid injection line coupled to the flash tank and to the second compressor, a liquid refrigerant from the flash tank to mix with the refrigerant from the first compressor before the refrigerant from the first compressor is received by the second compressor.

8. The method of claim 7, further comprising:

removing, by a second high side heat exchanger, heat from the refrigerant from the first compressor; and sending, by the second high side heat exchanger, the refrigerant to the second compressor.

9. The method of claim 7, further comprising controlling, a pulse valve coupled to the liquid injection line, the flow of the liquid refrigerant through the liquid injection line.

10. The method of claim 9, wherein the pulse valve is configured to open when a pressure differential between the second compressor and the liquid injection line is at least 45 pounds per square inch.

11. The method of claim 7, further comprising controlling, by a flash gas bypass valve coupled to the flash gas bypass line, the flow of flash gas through the flash gas bypass line.

12. The method of claim 11, wherein the flash gas bypass valve is configured to create a pressure differential of at least 45 pounds per square inch between the second compressor and the liquid injection line.

13. The method of claim 7, wherein the high side heat exchanger is operated as a gas cooler.

14. A system comprising:

a flash tank configured to store a refrigerant;

a load configured to use the refrigerant from the flash tank to remove heat from a space proximate the load;

a first compressor configured to compress the refrigerant from the load;

a second compressor configured to compress the refrigerant from the first compressor;

a liquid injection line coupled to the flash tank and to the second compressor, the liquid injection line configured to send a liquid refrigerant from the flash tank to mix with the refrigerant from the first compressor before the refrigerant from the first compressor is received by the second compressor; and a pulse valve coupled to the liquid injection line, the pulse valve configured to control the flow of the liquid refrigerant through the liquid injection line.

15. The system of claim 14, further comprising a high side heat exchanger configured to remove heat from the refrigerant from the first compressor, the high side heat exchanger configured to send the refrigerant to the second compressor.

16. The system of claim 14, wherein the pulse valve is configured to open when a pressure differential between the second compressor and the liquid injection line is at least 45 pounds per square inch.

17. The system of claim 14, wherein the pulse valve is configured to open when a temperature of the refrigerant exceeds a threshold.

18. The system of claim 14, further comprising a high side heat exchanger operated as a gas cooler.

* * * * *